US011739481B2

(12) United States Patent
Borgers et al.

(10) Patent No.: US 11,739,481 B2
(45) Date of Patent: Aug. 29, 2023

(54) PAVEMENT BREAKER

(71) Applicant: Black & Decker Inc., New Britain, CT (US)

(72) Inventors: Benjamin Borgers, Idstein (DE); Clemens Dunser, Mainz (DE); Benjamin Schmidt, Mainz (DE); Andreas Friedrich, Limburg (DE)

(73) Assignee: Black & Decker Inc., New Britain, CT (US)

( * ) Notice: Subject to any disclaimer, the term of this patent is extended or adjusted under 35 U.S.C. 154(b) by 635 days.

(21) Appl. No.: 15/287,885

(22) Filed: Oct. 7, 2016

(65) Prior Publication Data

US 2017/0101747 A1 Apr. 13, 2017

(30) Foreign Application Priority Data

Oct. 13, 2015 (GB) ..... 15180088

(51) Int. Cl.

| | |
|---|---|
| ***E01C 23/12*** | (2006.01) |
| ***B25D 17/12*** | (2006.01) |
| ***B25D 11/06*** | (2006.01) |
| ***B25D 17/04*** | (2006.01) |
| ***B25D 11/00*** | (2006.01) |
| ***B25D 9/26*** | (2006.01) |

(52) U.S. Cl.

CPC ..... *E01C 23/122* (2013.01); *B25D 9/265* (2013.01); *B25D 11/005* (2013.01); *B25D 11/06* (2013.01); *B25D 17/04* (2013.01); *B25D 17/043* (2013.01); *B25D 2250/221* (2013.01); *B25D 2250/265* (2013.01)

(58) Field of Classification Search

CPC ..... E01C 23/122; B25D 9/265; B25D 11/005; B25D 11/06; B25D 17/04; B25D 17/043; B25D 2250/221; B25D 2250/265

USPC ..... 173/117

See application file for complete search history.

(56) References Cited

U.S. PATENT DOCUMENTS 1,887,762 A * 11/1932 Horton ..... B25D 11/10 173/205
RE23,104 E * 4/1949 Price ..... B25D 17/24 173/170

(Continued)

FOREIGN PATENT DOCUMENTS

DE 1855677 U 7/1962
DE 6931913 U 8/1972

(Continued)

OTHER PUBLICATIONS

EP Search Report dated Feb. 27, 2017 issued in corresponding EP patent application.

*Primary Examiner* — Thomas M Wittenschlaeger
*Assistant Examiner* — David G Shutty
(74) *Attorney, Agent, or Firm* — Amir R. Rohani

(57) ABSTRACT

A pavement breaker has a housing, a hammer mechanism mounted within the housing, and at least one handle moveably mounted on the housing. The handle(s) can move in a vertical direction when the pavement breaker is orientated in its normal operation orientation. A sensor is mounted within the housing for detecting when the handle(s) is moved towards or at its uppermost position. If the sensor detects such handle position, the hammer mechanism is deactivated.

15 Claims, 7 Drawing Sheets

(56) References Cited

U.S. PATENT DOCUMENTS 2,630,784 A * 3/1953 Wallerstein, Jr. .... B25D 17/043 173/162.1
2,672,129 A * 3/1954 Fischer ..... B25D 9/08 137/624.14
2,676,464 A * 4/1954 Warren ..... B25D 9/12 173/169
2,906,244 A * 9/1959 Christensen ..... B25D 9/145 16/431
2,984,210 A * 5/1961 Fuehrer ..... B25D 17/043 16/431
3,179,185 A * 4/1965 O'Farrell ..... B25D 17/24 173/133
3,263,770 A * 8/1966 Staffan ..... B25D 17/11 181/230
3,559,753 A * 2/1971 Meri ..... B25D 17/12 173/137
3,824,417 A * 7/1974 Moores, Jr. ..... B25D 17/043 173/117
4,440,237 A * 4/1984 Casperovich ..... B25D 17/245 173/206
4,673,043 A * 6/1987 Greppmair ..... B25D 17/11 173/162.2
5,031,273 A * 7/1991 Yamaguchi ..... B25D 17/043 16/431
5,107,911 A * 4/1992 Plakotaris ..... B25D 17/02 144/193.1
5,273,120 A * 12/1993 Chang ..... B25D 17/043 16/431
5,369,236 A 11/1994 Nickels
5,524,714 A * 6/1996 Kimberlin ..... B25D 9/16 173/168
5,524,715 A * 6/1996 Kimberlin ..... B25D 9/16 173/168
5,749,421 A * 5/1998 Johansson ..... B25D 9/16 173/128
5,775,196 A * 7/1998 Henriksson ..... F01L 25/04 91/299
5,875,856 A * 3/1999 Gustavsson ..... B25D 17/04 173/168
7,624,815 B2 * 12/2009 Friedrich ..... B03C 1/286 173/126
7,726,413 B2 * 6/2010 Berghauser ..... B25D 17/082 173/171
7,868,263 B2 * 1/2011 Hammerstingl ..... B25D 17/043 200/332.2
8,235,136 B2 * 8/2012 Berger ..... B25D 11/005 173/109
8,250,910 B2 * 8/2012 Rolew ..... G01P 13/045 73/114.26
8,342,260 B2 * 1/2013 Buchenau ..... B25G 1/01 173/162.1
2004/0200628 A1 * 10/2004 Schmitzer ..... B25D 16/006 173/1
2004/0231867 A1 * 11/2004 Becht ..... B25D 17/043 173/162.2
2007/0144750 A1 * 6/2007 Buchenau ..... B25D 17/043 173/162.2
2008/0006420 A1 * 1/2008 Berghauser ..... B25D 17/08 173/117
2008/0006426 A1 * 1/2008 Friedrich ..... B03C 1/286 173/210
2008/0099219 A1 * 5/2008 Schmid ..... B25D 17/043 173/90
2008/0196913 A1 * 8/2008 Bram ..... B25D 17/043 173/162.2
2009/0032276 A1 * 2/2009 Koch ..... B25D 17/043 173/131
2009/0120770 A1 * 5/2009 Hammerstingl ..... B25D 17/043 200/61.85
2013/0333909 A1 * 12/2013 Binder ..... B25D 11/064 173/117
2015/0090470 A1 * 4/2015 Miwa ..... B25D 17/24 173/117
2015/0151419 A1 * 6/2015 Bralla ..... B25D 11/064 173/1
2017/0101747 A1 * 4/2017 Borgers ..... B25D 11/06

FOREIGN PATENT DOCUMENTS

DE 36 10 682 10/1987
DE 10 2005 028918 12/2006
DE 102010032351 A1 2/2012
DE 102011078082 A1 12/2012
DE 10 2012 005803 9/2013
DE 102012005803 A1 * 9/2013 ..... B25D 9/265
EP 1166972 A2 * 1/2002 ..... B25D 17/04
EP 1872913 A2 * 1/2008 ..... B25D 17/082
EP 2172311 A1 4/2010
EP 1535247 B1 7/2010
EP 2 324 961 5/2011
EP 1883507 B1 11/2012
GB 242218 3/1926
GB 242218 A * 3/1926 ..... B25D 17/043
GB 340870 A 1/1931
GB 714300 * 8/1954 ..... B62D 15/021
GB 714300 A * 8/1954 ..... B25D 17/043
GB 2468576 * 9/2010 ..... G01P 3/487
GB 2468576 A 9/2010

* cited by examiner

PAVEMENT BREAKER

FIELD OF THE INVENTION

The present invention relates to a pavement breaker.

BACKGROUND

EP1157788 (and corresponding U.S. Pat. No. 6,666,284) discloses a typical hammer drill which can operate in a hammer only mode, a drill only mode and a combined hammer and drill mode.

EP1872913 (and corresponding U.S. Pat. No. 7,726,413) discloses a hammer drill which can operate in a hammer only mode. This type of hammer drill is often referred to as a pavement breaker. In addition to the fact that a pavement breaker only operates in one mode of operation when compared with a typical hammer drill, pavement breakers are much heavier than a typical hammer drill and therefore are usually operated in a limited range of angular positions with the cutting tool generally pointing in a downward manner towards the work piece being cut (the "normal operation orientation"). In such an orientation, the weight of the pavement breaker is mainly supported by the cutting tool, the weight of the pavement breaker urging the cutting tool into the work piece being cut when the pavement breaker is in operation. As such, during the normal use of the pavement breaker, the support handles are used to orientate the pavement breaker, rather than support the weight of pavement breaker as is normally the case on typical hammer drills.

The hammer mechanisms in pavement breakers are either driven by an electric motor or are powered by a pneumatic drive system. If the pavement breaker is driven by an electric motor, an electrical power source is supplied via an electric cable either from a mains power supply or a generator. Theoretically, a pavement breaker with an electric motor could be powered by a battery. However, battery technology is presently insufficiently developed to enable a practical design to be produced. If the pavement breaker is powered by a pneumatic drive system, a high pressure air source is supplied via a hose from a compressor.

During the operation of such pavement breakers, a considerable amount of vibration can be generated. The vibration is caused by the operation of the hammer mechanism combined with the vibratory forces applied to and experienced by the cutting tool when it is being used on a work piece. These vibrations are transferred to the body of the pavement breaker, which in turn are transferred to the support handles being used by the operator to orientate the pavement breaker. It is therefore desirable to minimize the amount of vibration transferred from the body to the support handles.

One solution is to moveably mount the support handles on the body of the pavement breaker to allow relative movement between the two and to locate a vibration dampening mechanism between the body and the support handles to minimize the amount of vibration transferred to the support handles from the body.

GB2468576 discloses one such design of vibration dampener for the support handles of a pavement breaker. In GB2468576, the support handles of the pavement breaker are pivotally mounted on the body of the pavement breaker via vibration dampeners. As the pavement breaker operates, the handles are able to move relative to the body of the pavement breaker by pivoting about an axis. The pivotal movement of the support handles is damped by the vibration dampeners which reduce the amount of vibration transferred from the body to the support handles.

When pavement breakers are moved around, they are often lifted up using the support handles and either placed on a trolley or vehicle for transportation, due to their weight, or to a new work piece which is to be cut by the pavement breaker. If the pavement breaker is being moved to a new work piece, the electrical power source or the high pressure air source often remains connected to the pavement breaker and is capable of providing power to drive the motor of the pavement breaker. This could result in the pavement breaker being accidentally switched on as the operator is moving the pavement breaker by the support handles. A pavement breaker is designed to be operated only when the cutting tool is pressing against a work piece. This is so that the striking force generated by the hammer mechanism is transferred through the cutting tool and into the work piece. If the pavement breaker is operated when the cutting tool is not engaged with a work piece, all of the energy of the hammer mechanism is imparted to the cutting tool only. This can result in damage to the pavement breaker as all of the energy has to be subsequently absorbed by the pavement breaker's tool holder which supports the cutting tool.

DESCRIPTION

Figure 1:
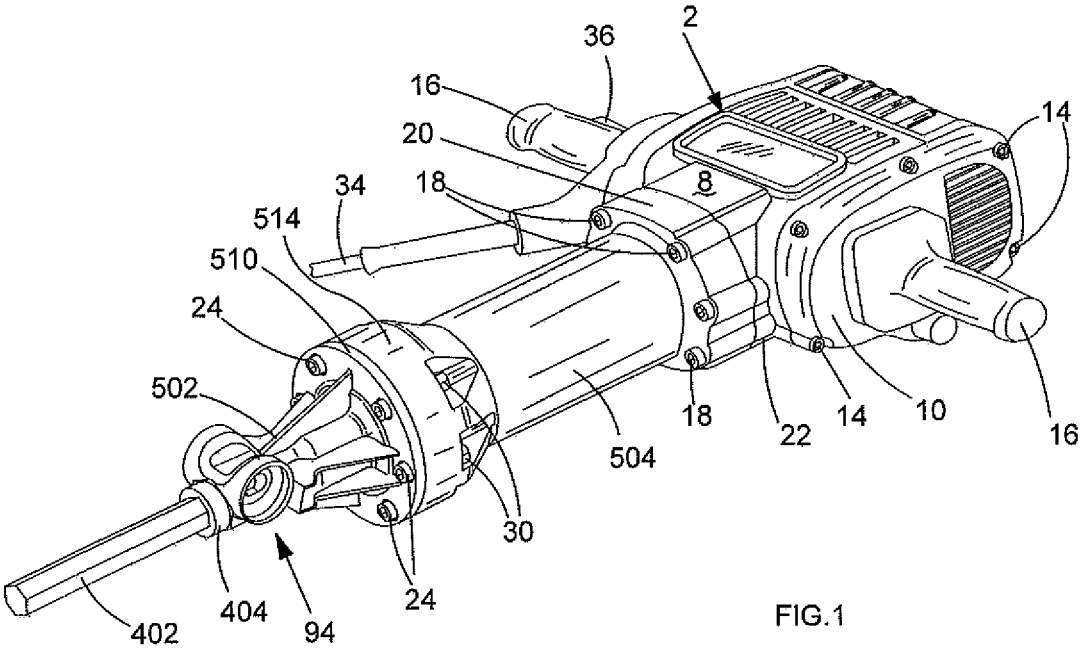
FIG. 1 is a perspective view of a pavement breaker.
Figure 7:
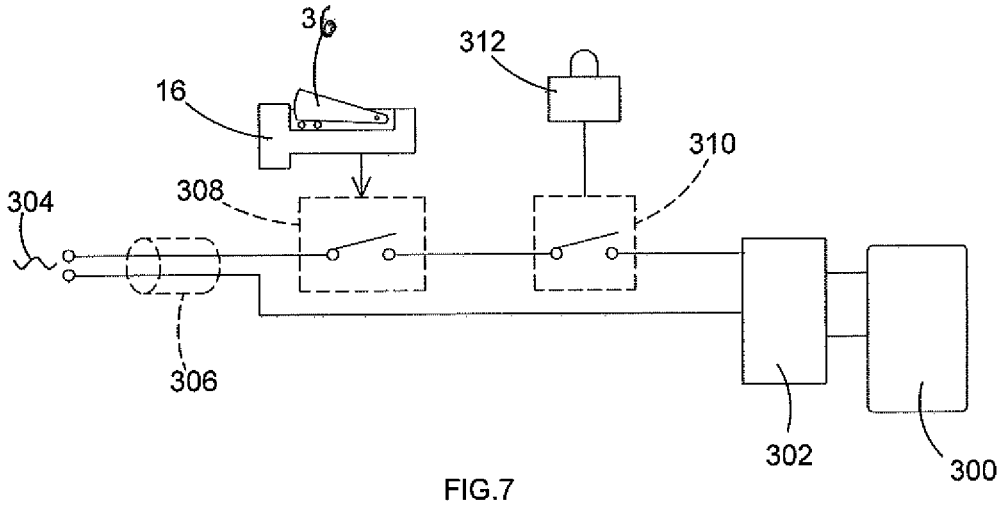
FIG. 7 shows a simplified schematic of the electrical circuit of the pavement breaker.

FIG. 1 is FIG. 7 of EP1872913 (and of corresponding U.S. Pat. No. 7,726,413) which describes one type of pavement breaker. Referring to FIG. 1, the body of the pavement breaker comprises a motor housing 2 which is preferably formed from a central housing 8 and two side panels 10 attached to the sides of the central housing 8 via screws 14.

Figure 2:
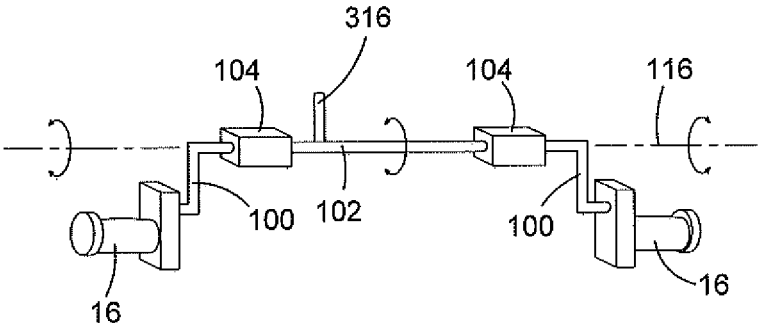
FIG. 2 is an operational diagram of the handles.

Two handles 16 may be moveably mounted on the motor housing 2 and are preferably connected to each other in a manner shown in FIG. 2.

An electric motor (300, shown in FIG. 7) is mounted within the motor housing 2. A hammer mechanism 318 is preferably in a hammer mechanism housing 504, which in turn is attached to the motor housing 2. Hammer mechanisms for electrical pavement breakers are well known in the art and therefore will not be described in any more detail. EP1872913 (and corresponding U.S. Pat. No. 7,726,413) describes an example of such a hammer mechanism. The hammer mechanism is driven by the electric motor 300.

A tool holder 94 is preferably attached to the hammer mechanism housing 504, remotely from the motor housing 2. The tool holder 94 is capable of holding a cutting tool 402. When the hammer mechanism 318 is driven by motor 300, the hammer mechanism 318 imparts impacts onto the cutting tool 402 when held in the tool holder 94.

Referring to FIG. 2, each handle 16 of a pavement breaker may be rigidly connected via a link 100 to the end of a metal rod 102. The metal rod 102 preferably passes through the motor housing 2. Two segments 104 are preferably formed along the rod 102 and have a square cross section. Each of the segments 104 are mounted to a side panel 10 via a rotary vibration dampener 106.

Figure 4:
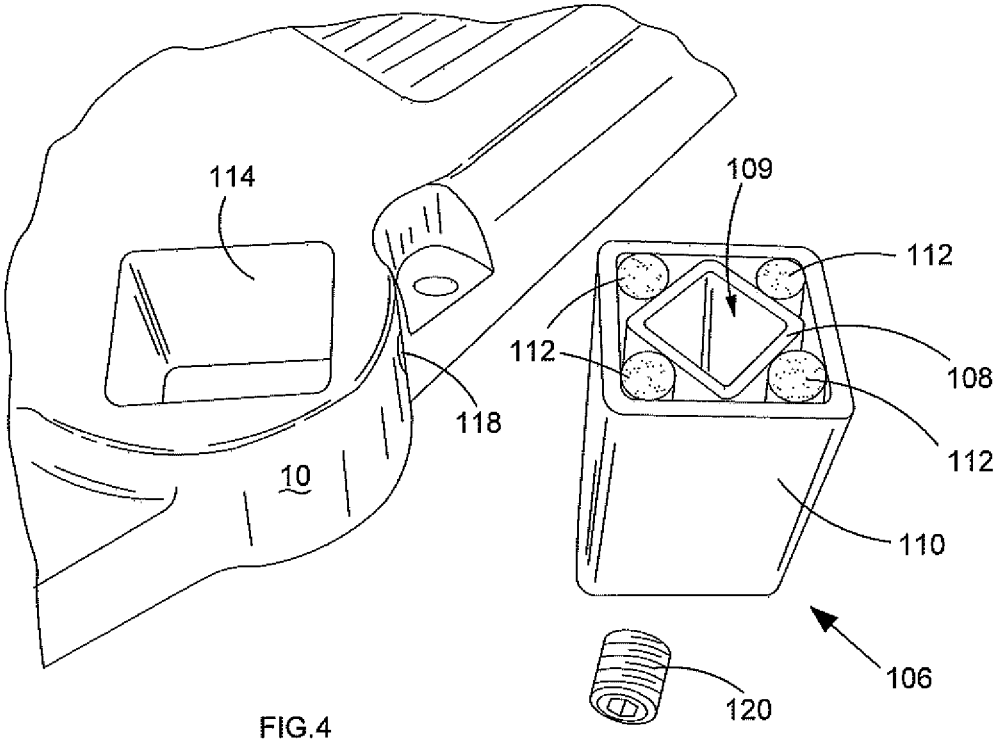
FIG. 4 shows a rotational vibration dampener separate from the side panel of FIG. 3.
Figure 5:
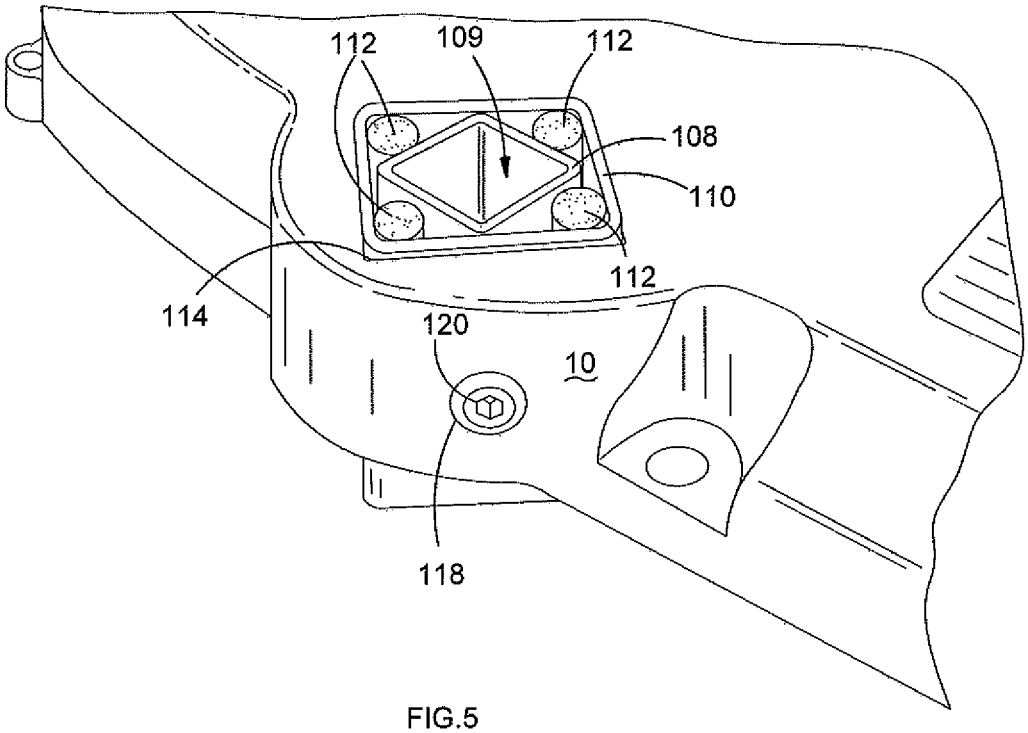
FIG. 5 shows the vibration dampener of FIG. 4 located in the side panel of FIG. 3.

FIG. 4 shows part of a side panel 10, with an empty square aperture 114, and the vibration dampener 106 adjacent the side panel 10. FIG. 5 shows part of the side panel 10 with the vibration dampener 106 located within the square aperture 114 of the panel 10.

Referring to FIGS. 4 and 5, each of the vibration dampeners 106 preferably comprise an inner rigid square tube 108 located within an outer rigid square tube 110, their longitudinal axes being parallel and co-axial. Sandwiched between them are four rubber rods 112 which are resilient in nature and are deformed by relative pivotal movement between the two tubes 108, 110. The rods 112 have a uniform shaped cross section along their lengths which is circular when not deformed. The rubber rods 112 are positioned so that the two square tubes 108, 110 are orientated by 45 degrees relative to each other about their longitudinal axes. The rubber rods 112 allow rotational movement between the inner and out square tubes 108, 110 over a limited range of movement about the longitudinal axes of the tubes 108, 110.

Each of the vibration dampeners 106 is preferably located within a square aperture 114 formed in each side panel 10. The dimensions of each square aperture 114 preferably corresponds with those of the outer square tubes 110. As such, initially, there is no movement between the outer square tube 110 and the panel 10.

Each of the square segments 104 of the rod 102 is sized to fit within the passageway 109 formed inside of the inner square tube 108. The square segments 104 are dimension to locate inside of the inner square tubes 108 of the vibration dampeners 106 with no relative movement between the inner square tube 108 and the rod 102.

However, due to rubber rods 112 allowing relative movement between the inner and outer square tubes 108, 110, there is limited rotational movement between the rod 102 and the panels 10 about the longitudinal axis 116 of the rod 102. Thus the handles 16 can pivot about the longitudinal axis 116 relative to the panels 10.

The vibration dampeners 106 preferably reduce the amount of vibration transferred from the motor housing 2 to the handles 16 by the rubber rods 112 absorbing vibration by allowing limited damped pivotal movement between the inner and outer square tubes 108, 110.

Figure 3:
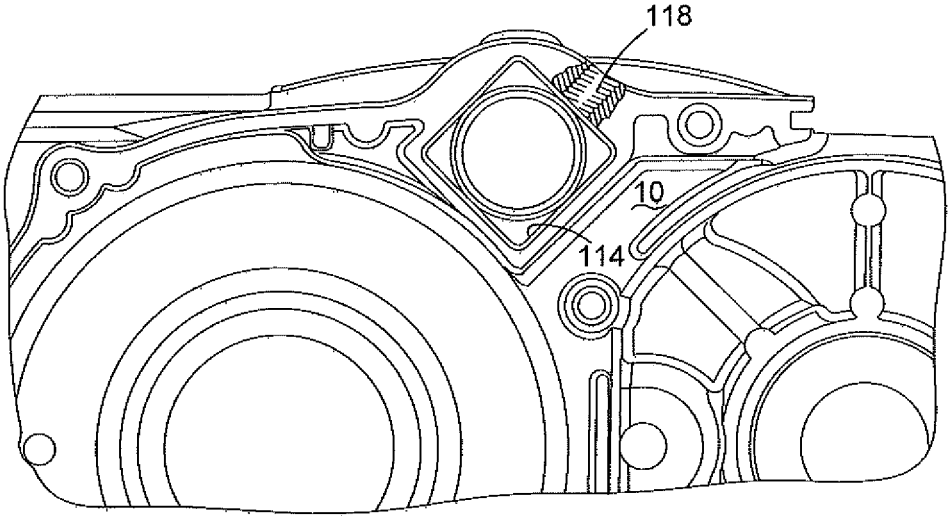
FIG. 3 is a cross sectional view of a side panel.

Over time, the shape of the square apertures 114 in the side panels 10 may become distorted due to the pressure applied via the handles 16 on the panels 10, allowing relative movement between the outer square tube 110 and the panels 10, thus allowing the vibration dampeners 106 and handles 16 to freely move. A threaded bore 118 is preferably provided in each of the panels 10 which meet with the square apertures 114 (see FIG. 3).

A screw 120 can be screwed into each threaded bore 118 until it engages with the side of the outer square tube 110 as shown in FIG. 5. When the square apertures 114 in the side panels 10 become distorted, the screw 120 can be further screwed into the bore 118 until it presses tightly against the outer square tube 110 to prevent the outer square tube 110 from moving inside of the square aperture 114. The screw 120 can subsequently be screwed out of the bore 118 to disengage it from the vibration dampener 106.

When no pressure is applied to the handles 16, the two links 100 may extend in a generally horizontal direction when the pavement breaker is orientated vertically (with the longitudinal axis of the cutting tool 402 being vertical). During the normal operation of the pavement breaker, the operator grasps the handles 16 and uses them to orientate the pavement breaker. When the pavement breaker is operated, the body of the pavement breaker vibrates with the majority of the movement being in the vertical direction. As the body vibrates, the handles 16 pivot in a reciprocating manner about the longitudinal axis 116 of the rod 102, the handles 16 first moving to a position below the rod 102 and then to a position above the rod 102 before repeating the movement in a repetitive manner. The vibration dampeners 106 reduce the amount of vibration transferred to the handle 16 from the panels 10.

The vibration dampeners 106 allow the rod 102 to pivot between two extreme angular positions. However the amount of movement of the panels 10 relative to the handles 16 under normal working conditions is such that the handles 16 do not typically move to such an extent forcing rod 102 to pivot to these extreme positions. Accordingly the range of pivotal movement of the rod 102 during operation is typically considerably less than the range between the extreme positions, and rarely approaches these extreme positions.

Sometimes the operator will apply a downward pressure onto the handles 16 in the belief that it will increase the force applied by the cutting tool 402 on the work piece. In such circumstances, the handles 16 will move to a position which is further below the rod 102 and to a position which is a smaller amount above the rod 102. In such circumstances, the rod 102 may pivot towards one of the extreme angular positions when the handles 16 are in their lowest position.

Referring to FIG. 7, mounted in the motor housing 2 is an electric motor 300 which drives the hammer mechanism 318. The electric motor 300 is preferably electrically connected to a motor controller 302 which controls the operation of the motor 300. The motor controller 302 is connected to a mains power supply 304 via a cable 306. A switch 308 is preferably mounted in one of the handles 16.

Figure 6:
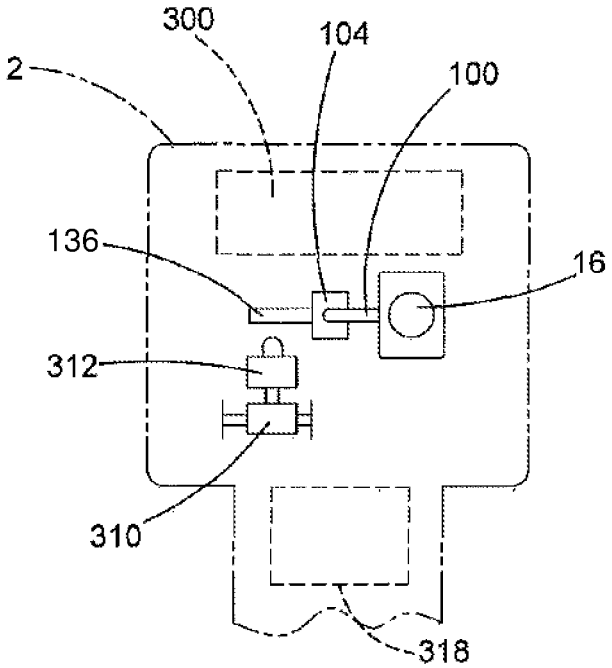
FIG. 6 is an operational diagram of the handle mounted on the pavement breaker.

A switching device, such as a solid state switch (a FET, bipolar transistor, triac, thyristor etc) or electrical relay 310, may be mounted within the motor housing 2 as shown schematically in FIG. 6. The switching device, e.g., relay 310, is preferably opened and closed by a micro switch 312 which is in electrical connection with the relay 310 and which is also preferably mounted within the motor housing 2.

The switch 308 in the handle 16 is preferably connected to a pivotal lever 36 mounted on the handle 16. Depression of the lever 36 by an operator operates the switch 308 in order to close the switch 308 and allow electric current to pass through it.

A metal arm 316 may be attached to the rod 102 which supports the handles 16. The arm 316 preferably extends in a direction parallel to the two links 100, As the rod 102 pivots about the axis 116, the arm 316 similarly pivots, the end of the arm 316 moving up and down as it does so. When no pressure is applied to the handles 16, the arm 316 is generally horizontal when the pavement breaker is in its normal operation orientation.

A micro switch 312 may be mounted in the motor housing 2 below the end of the arm 316. When the handles 16 are raised towards their highest position, the end of the arm 316 preferably pivots downwardly and engages with the micro switch 312. When the arm 316 is engaged with the micro switch 312, the micro switch 312 is activated and sends an electrical signal to the relay 310. When the relay 310 receives the signal, the relay 310 opens and prevents any electric current from passing through the relay 310. When the arm 316 is not in contact with the micro switch 312, the micro switch 212 sends no signal to the relay 310. When the relay 310 receives no signal, the relay 310 closes, allowing electrical current to pass through the relay 310 with minimal resistance.

During the normal operation of the pavement breaker, the pavement breaker will be vertical with cutting tool 402 being pointed downwardly in a vertical direction (and referred to as its normal operation orientation). During such operation, the handles 16 preferably pivot through a range of movement which results in the arm 316 making no contact with the micro switch 312. As such, the relay 310 remains closed, allowing electrical current to pass through the relay 310 with minimal resistance. Therefore upon depression of the lever 36 by an operator, the switch 308 closes, allowing electric current to pass through it and the relay 310, switching the motor 300 on and activating the pavement breaker. As such, the operator can use the pavement breaker in the normal manner.

When the operator picks up the pavement breaker using the handles 16 to move it, the handles 16 will pivotal towards their highest position (the pavement breaker being vertical with the cutting tool pointing downwardly due to the weight). When the handles 16 move towards their highest position, the end of the arm 316 will move downwardly and engage the micro switch 312. When the arm 316 is engaged with the micro switch 312, the micro switch 312 is activated and sends an electrical signal to the relay 310 which in turn causes the relay 310 to open and prevent any electric current from passing through the relay 310.

Therefore, if the operator accidentally depresses the lever 36 while moving the pavement breaker by the handles 16, the pavement breaker would be prevented from being activated. Similarly, if an operator decides to move the pavement breaker during its operation, the pavement breaker would automatically switch off when the operator tries to lift the pavement breaker using the handles 16.

Persons skilled in the art will recognize that a mechanical block can be located in the motor housing 2 to prevent the arm 316 from over-rotating or putting too much force unto and thus damaging the micro switch 312 when the pavement breaker is lifted up by the handles 16. In addition, persons skilled in the art will appreciate that micro switch 312 could be located at a position where it is only engaged when the handles 16 are moved to their extreme upper position rather approaching their extreme upper position.

In an alternative embodiment, the handles 16 may be biased towards their uppermost position. In such a design, the operator would have to apply a downward pressure onto the handles 16, to disengage the arm 316 from the micro switch 312, prior to the pavement breaker being able to be switched on using the lever 36. However, this would result in the operator constantly having to apply a downward pressure to the handles 16 in order to operate the pavement breaker.

The description of the invention is merely exemplary in nature and, thus, variations that do not depart from the gist of the invention are intended to be within the scope of the invention. For example, persons skilled in the art will recognize that, while the described pavement breaker is powered by an electric motor 300, the invention is also applicable to a pneumatic pavement breaker where the hammer mechanism is driven via a pneumatic drive system. Such variations are not to be regarded as a departure from the scope of the invention.

The invention claimed is:

1. A pavement breaker comprising:

a housing having two opposite side panels defining apertures on two sides of the housing;

a hammer mechanism mounted within the housing;

two handles moveably mounted on the housing, the two handles having ends received within the apertures in the side panels of the housing, the two handles being moveable relative to the housing in at least in a vertical direction between at least an upper position and a lower position when the pavement breaker is orientated in a normal operation orientation;

a rod having two ends coupled to the ends of the two handles, the rod extending between the side panels of the housing and being rotatable around a rotation axis with movement of the two handles between the upper position and the lower position; and a sensor mounted within the housing, the sensor interfacing with the rod to detect movement of the two handles to the upper position relative to the housing based on rotation of the rod around the rotation axis relative to the sensor;

wherein, when the sensor detects that the two handles are moved to the upper position, the hammer mechanism is deactivated.

2. The pavement breaker of claim 1 wherein the two handles are pivotally mounted on the housing.

3. The pavement breaker of claim 2 wherein the two handles are movable through a range of vertical positions between the upper position and the lower position.

4. The pavement breaker of claim 3 wherein the two handles are biased to a position between the upper position and the lower position.

5. The pavement breaker of claim 4 wherein the two handles are biased to a position midway between the upper position and the lower position.

6. The pavement breaker of claim 3 wherein the hammer mechanism is driven by an electric motor.

7. The pavement breaker of claim 6 wherein, when the sensor detects that the two handles are moved to the upper position, the electric motor is deactivated.

8. The pavement breaker of claim 3, further comprising an arm connected to and moveable with the two handles.

9. The pavement breaker of claim 8, wherein the sensor is a switch which is engaged by the arm when two handles are moved to the upper position.

10. The pavement breaker of claim 9, wherein the hammer mechanism is driven by an electric motor.

11. The pavement breaker of claim 10, further comprising a controller for controlling the electric motor.

12. The pavement breaker of claim 11, wherein the sensor is connected to the controller.

13. The pavement breaker of claim 12, wherein the sensor sends the controller a signal indicating that the two handles have moved to the upper position.

14. The pavement breaker of claim 13, wherein the controller prevents activation of the electric motor upon receipt of the signal in order to prevent activation of the hammer mechanism.

15. The pavement breaker of claim 1, further comprising a pivotal lever mounted on one of the two handles, wherein depression of the pivotal lever operated a switch to supply electric power to activate the hammer mechanism.

* * * * *